United States Patent [19]

Artzt et al.

[11] Patent Number: 4,698,962

[45] Date of Patent: Oct. 13, 1987

[54] PROCESS AND DEVICE FOR THE PRODUCTION OF A FANCY YARN ON OPEN-END SPINNING DEVICES

[75] Inventors: Peter Artzt, Reutlingen; Heinz Miller, Metzingen-Neuhausen, both of Fed. Rep. of Germany

[73] Assignee: Schubert & Salzer, Ingolstadt, Fed. Rep. of Germany

[21] Appl. No.: 915,534

[22] Filed: Oct. 6, 1986

[30] Foreign Application Priority Data

Oct. 16, 1985 [DE] Fed. Rep. of Germany ..... 3536827

[51] Int. Cl.[4] ..... D01H 7/892; D01H 7/898

[52] U.S. Cl. ..... 57/409

[58] Field of Search ..... 57/90, 91, 317, 400, 57/403, 404, 408, 409, 411, 413

[56] References Cited

U.S. PATENT DOCUMENTS

| | | | |
|---|---|---|---|
| 3,501,907 | 3/1970 | Tabata et al. | 57/140 |
| 3,523,300 | 8/1970 | Tabata et al. | 57/409 |
| 3,768,246 | 10/1973 | Tabata et al. | 57/156 |
| 3,956,876 | 5/1976 | Artzt et al. | 57/58.95 |
| 3,998,040 | 12/1976 | Ripka et al. | 57/409 |

FOREIGN PATENT DOCUMENTS

| | | |
|---|---|---|
| 2427455 | 12/1975 | Fed. Rep. of Germany . |
| 2617563 | 8/1977 | Fed. Rep. of Germany . |

OTHER PUBLICATIONS

PCT Published Application 79/00489, inventor Olsson, with published international search report, published Jul. 26, 1979.

*Primary Examiner*—Donald Watkins

*Attorney, Agent, or Firm*—Dority & Manning

[57] ABSTRACT

When producing fancy yarn on open-end spinning devices, sliver-like basic fiber material is opened into individual fibers and is fed in an air stream to an open-end spinning element. A fiber sliver of the fancy-effect fiber material is conveyed at constant speed into an air stream by which fiber tufts are separated. Fancy-effect fiber tufts and individual fibers thus separated are fed to an open-end spinning element together with the opened basic fiber material. To carry out this process, a feeding device is provided for the fancy-effect fiber material, such feeding device being driven at constant speed so that the fancy-effect fiber material is brought into the fiber feeding channel in the form of an uninterrupted fiber sliver.

32 Claims, 5 Drawing Figures

PROCESS AND DEVICE FOR THE PRODUCTION OF A FANCY YARN ON OPEN-END SPINNING DEVICES

BACKGROUND AND SUMMARY OF INVENTION

The instant invention concerns a process for the production of a fancy yarn on open-end spinning devices in which sliver-like basic fiber material is opened into individual fibers and is fed in an air stream to an open-end spinning element, as well as a device to carry out this process.

In a known device of this type (DE-OS No. 2.953.527) corresponding to PCT Published Application No. 79/00489 the fancy-effect fiber material is opened by means of drawing rollers and the pieces of fancy-effect material thus produced are thrown by an air stream against a screen for the purpose of being conveyed on to the gap between a pair of rotating friction rollers, where they combine with the basic material and are twisted together into a yarn. By means of a programming mechanism which influences the drive of the drawing rollers for the production of the fancy-effect material pieces, the frequency length and the thickness of the fancy material pieces in the fancy yarn are determined. Such a drive, controlled by the programming mechanism, is expensive. Furthermore, only those effects can be produced which have been input into the program mechanism. Since such a program only has a limited range of variation it is unavoidable that variations repeat themselves, even where costly programming is involved. It is however desirable that if at all possible no repetitions of the variations occur in fancy yarn, or that variations repeat themselves only after long periods.

It is the objective of the instant invention to create a process and a device for the production of fancy yarns which makes it possible to obtain by a simple method maximum random distribution of the effects.

This objective is attained according to the invention in that the fancy-effect fiber material is conveyed at constant speed in form of a closed, i.e. uninterrupted fiber sliver to an air stream and in that fiber tufts are separated by this air stream, the fiber tufts thus separated being conveyed to the open-end spinning element together with the opened basic fiber material. The opening of the fiber material which produces the fancy effects is therefore not effected by a mechanically operating opening device, as was done previously, but by the suction effect of the flowing air to which this material is conveyed. The air flow separates the fibers in an uneven fashion from the forward end of the fiber sliver which is retained by a feeding device. The distribution of the fancy-effect fiber material within the finished fancy yarn is therefore random with respect to size and sequence of the fiber groups or fibers separated from the fiber sliver. To carry out the process, a normal conveying device without any controls suffices, since it is not necessary to control the effects by means of variable feeding of the fancy-effect fiber material. This inventive process is especially well suited for the production of yarns with color effects. The inventive process is also eminently suitable for thin yarns in which the effects cannot be produced in the desired fine gradations because of the slowness of the known device.

To obtain good opening of the fancy-effect fiber material and to avoid thread breakage which may be caused by oversized fiber tufts, the invention provides for a flowing speed of the air stream which is considerably greater thant that of the fancy-effect fiber material.

To assist the pneumatic opening of the fancy-effect fiber material, the latter is subjected to retention in further variants of the inventive process, immediately before being brought into the air stream.

In order to ensure good mixing of the individual fibers of the basic fiber material with the fancy-effect fiber material as well as uniform yarn output, a preferred variant of the inventive process provides for the fancy-effect material air stream and for the fiber tufts thus separated by this fancy-effect material air stream to be conveyed to the conveying air stream of the basic fiber material.

To give the individual fibers separated from the fancy-effect fiber material sufficient time for straightening, the fancy-effect fiber material is preferably conveyed to the air stream during the latter's acceleration.

The flow of the individual fibers separated from the basic fiber material is not affected when suitable provisions are made for the opening of the fancy-effect fiber material to occur before the end of air stream acceleration.

To avoid affecting the parallel orientation of the fibers as they are being conveyed, a suitable variant of the inventive process furthermore provides for the conveying air stream and for the fancy material air stream to flow essentially in the same direction before being combined.

The opening of the fiber material which produces the fancy effects is entirely pneumatic and not mechanical. Thus the intensity of the air stream acting upon the fiber material is of particular importance for the opening of the fiber sliver made up of the fancy-effect fiber material. To avoid raising the negative pressure prevailing at the open-end spinning element merely for the opening of the fiber tuft, the fancy-effect fiber material is preferably fed into the conveying air stream for the basic fiber material at the point of highest air speed.

Variation of the effects can be achieved with the same fiber slivers being fed if the constant feeding speed of the fancy-effect fiber material is adjusted according to the effects one wishes to obtain.

To produce effects with more than only two colors, the fancy-effect fiber material can also be fed in the form of several fiber slivers, whereby these two or more fancy-effect fiber slivers can also be fed at different constant speeds.

To carry out the process described, the fiber feeding channel is equipped with a feeding opening in accordance with the invention, through which the fancy-effect fiber material, delivered at constant speed by the feeding device, is fed to the fiber feeding channel. The opening of the fancy-effect fiber material into fiber tufts is thus effected purely by pneumatic means.

Since it has been shown that the pneumatic opening of the fancy-effect fiber material can be assisted considerably by guiding it over a tear-off edge, such a tear-off or retention edge is preferably provided between the feeding device and the first fiber feeding channel.

To provide the best conditions possible for the separation of fibers and fiber tufts in the air stream, the fiber channel can be fashioned with a profile having surfaces at which the air stream it carries flows at different speeds, whrerby the feeding opening is located in the zone of higher air flow speed within the fiber feeding channel. For this purpose a sliver guide is preferably provided to hold the fiber sliver in the zone of greater air flow speed.

To ensure that the individual fibers separated from the basic fiber material as well as from the fancy-effect fiber material can stabilize before reaching the open-end spinning element, the invention provides for a fiber feeding channel with a tapering segment followed by a cylindrical segment, the feeding opening being located in the tapering segment of said fiber feeding channel.

According to the invention, opening of the fiber sliver made up of fancy-effect fiber material is to occur sufficiently early in the air stream so that the fiber sliver does not affect the orientation of the individual fibers separated from the basic fiber material. This is achieved according to this invention by means of the feeding opening consisting of the end of a fiber feeding channel for the fancy-effect fiber material, the length of which channel exceeds the maximum staple length of the individual fibers contained in the fancy-effect fiber material.

In order for the negative spinning air pressure to be as effective as possible within the second fiber feeding channel, thus ensuring thorough opening of the fancy-effect fiber material which is exposed to the air stream in form of a fiber sliver, the invention provides, in a preferred embodiment, that the fiber feeding channel for the fancy-effect fiber material lets out into the fiber feeding channel for the basic fiber material essentially in the longitudinal sense of the latter. If the fiber feeding channel for the basic fiber material starts out tangentially from an opening roller, the fiber feeding channel for the fancy-effect fiber material in a preferred embodiment of the object of the invention constitutes a rear extension of the fiber feeding channel for the basic fiber material.

To avoid excessive opening of the fancy-effect fiber material so that it may remain in the form of tufts even after pneumatic separation from the fiber sliver, the invention provides for the fancy-effect fiber material to be fed into the basic fiber material as it travels between the opening roller for the basic fiber material and the open-end spinning element. In order to attain nevertheless early feeding and thereby good mixing of the fibers, provisions can be made in a further embodiment of the object of the invention for a widening of the interior of the opening roller housing in the area where the fiber feeding channel for the basic fiber material begins, whereby the fiber feeding channel for the fancy-effect fiber material lets out tangentially to the opening roller into said widening.

It has been shown that without changing the device generally described above, normal yarn without fancy effect can also be spun by not feeding any fancy-effect fiber material to the feeding opening therefor. The air sucked in through the feeding opening does not affect the normal spinning process. However, it is also possible to provide a closing element for such feeding opening in a further embodiment of the invention, if this should be deemed to be conducive to better control of air flow conditions. Preferably this closing element is located in the area of the unopened fiber sliver so that no fibers already separated from the fiber sliver may catch on it when a fancy-effect yarn is being produced.

The feeding device is preferably equipped with an adjustable deive so that the constant feeding speed of the fancy-effect fiber material can be varied in relation to the basic fiber material.

According to the invention the feeding device for the fancy-effect fiber material can include a pair of rollers, or drawing equipment, whereby the draft within the drawing equipment is set so that the fiber sliver drawn in the drawing equipment is not opened into individual fibers but still remains in the form of a fiber sliver when leaving the drawing equipment, so that the separation of fiber tufts may only be effected pneumatically by a stream of air.

To increase the variety of possible fancy effects, several feeding devices and feeding openings for the feeding of fancy-effect fiber material into the fiber feeding channel can be provided.

The instant invention makes it possible to produce a deformation-resistant fancy-effect yarn, in particular a yarn with color effects, simply and without sliver preparation and chance variation, whereby the effects with respect to sequence and size are left to chance. The opening of the fancy-effect fiber material is not effected by mechanical means, so that none of the conventional opening devices are required for the fancy-effect fiber material. If the presented fiber material is still too thick for direct, pneumatic opening, the pair of rollers of the feeding device can be fashioned with the outlet roller pair of conventional drawing equipment which however draws the presented fiber material only to the extent that a closed, i.e. uninterrupted fiber sliver emerges from this drawing equipment. This fiber sliver is then opened by pneumatic means only. In this way irregular opening of the sliver-shaped fancy-effect fiber material is achieved without any special, randomly controllable and driveable opening equipment being required. The configuration of the device according to invention is thus a very simple one. Also, it is not necessary in an advantageous embodiment of the device according to invention to increase the negative spinning air pressure which produces the air stream for the opening of the fiber sliver from the pressure used in the normal spinning process, so that a device in accordance with the invention is not only simple in construction but also economical in operation.

BRIEF DESCRIPTION OF THE DRAWINGS

The invention is described hereinbelow in further detail through examples of embodiments and drawings, whereby all of the details which are not necessary to understand the invention have been omitted from the drawings for the sake of simplicity and clarity.

DETAILED DESCRIPTION OF THE PREFERRED EMBODIMENTS

Figure 1:
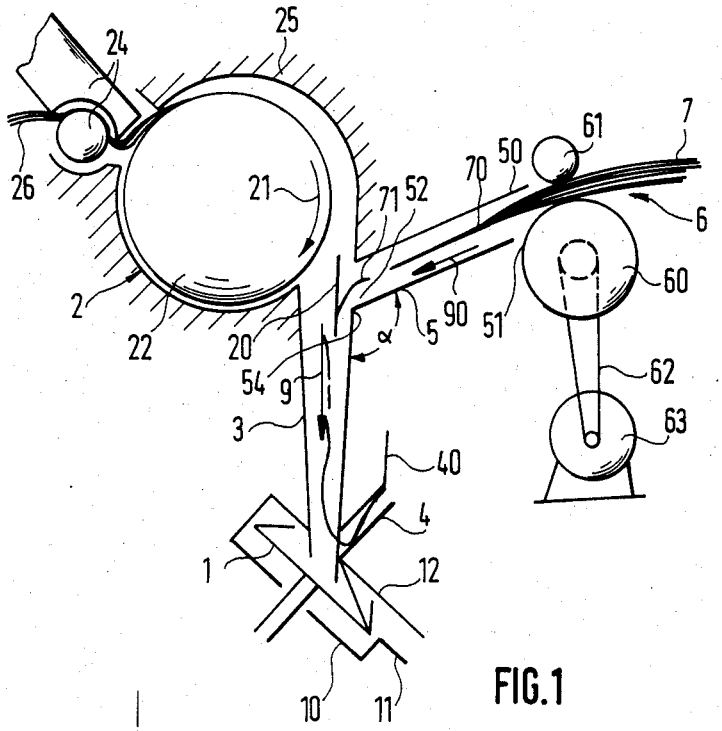
FIG. 1 shows a schematic side view of a first embodiment of a device in accordance with this invention.

The open-end spinning device shown in FIG. 1 features as its most essential elements a spinning element the form of a spinning rotor 1, an opening device 2 in the form of opening roller 22, and a fiber feeding channel 3 for the basic fiber 26, extending from the opening roller 22 to the spinning rotor 1.

The spinning rotor 1 is located in a housing 10 which is connected via a connection 11 to a source of negative air pressure (not shown). The housing 10 is closed by a cover 12 through which the fiber feeding channel 3 and a thread draw-off channel 4 extend into the interior of the spinning rotor 1.

The feeding opening 52 of a fiber feeding channel 5 for the fancy-effect fiber material 7 lets out into the fiber feeding channel 3 for the basic fiber material. A feeding device 6 is located before the feeding opening 50 of this fiber feeding channel 5. A gap is provided between the feeding device 6 and the fiber feeding channel 5 to form an air intake opening 51.

The feeding device 6 in the embodiment of FIG. 1 consists essentially of a pair of rollers made up of a driveable feeding roller 60 and a pressure roller 61 applied against it in an elastic manner. The feeding roller 60 is driven at constant speed by motor 63 via overdrive 62.

The basic fiber material 26 is fed in the conventional manner, by means of a feeding device 24, to the opening roller 22 located in a housing 25 and is opened into individual fibers 20 by the opening roller 22. The negative pressure at the connection 11 of housing 10 produces a conveying air stream 9 within the fiber feeding channel 3. This conveying air stream 9 serves as the conveying medium for the individual fibers 20 leaving the opening roller 22. In addition, this conveying air stream causes an air stream for the fancy-effect fiber material to be created within fiber feeding channel 5.

The continuously and uniformly driven feeding device 6 feeds the fancy-effect fiber material at constant speed in form of a fiber sliver 7 to the fiber feeding channel 5. The fiber sliver 7 can consist in this case of a somewhat twisted slubbing sliver or of a non-twisted drawing sliver. In either case this fiber sliver 7 still remains in form of a closed, i.e. uninterrupted fiber sliver after leaving the feeding device 6. The air stream 90 for the fancy-effect fiber material, mentioned earlier, which enters the fiber feeding channel 5 through the air intake opening 51, exerts strong suction upon the forward end 70 of the fiber sliver 7. The forward end 70 flutters back and forth in the fiber feeding channel 5 and is thus untwisted if fiber sliver 7 is a twisted fiber sliver. In the process individual fibers and fiber tufts 71, the backward end of which has left the clamping range of feeding device 6, are separated in an irregular manner from the fiber sliver 7 by the air and, with the assistance of fancy-effect fiber material air stream 90, are conveyed through the feeding opening 52 into the fiber feeding channel 3 where the individual fibers and fiber tufts 71, separated from fiber sliver 7, mix with the individual fibers 20 separated from the basic fiber material and are fed to the open-end spinning element, e.g. to a spinning rotor 1, together with the individual fibers 20 of the opened basic fiber material 26. The opening of fiber sliver 7 is thus effected by pneumatic means only, whereby the fancy effect is controlled solely by fiber friction.

The uncontrolled fluttering of the forward end 70 of the fiber band 7 causes the individual fibers and fiber tufts 71 to be separated pneumatically in an irregular manner from the fiber sliver 7 so that they vary in sequence and size. For this reason no homogenous fiber mixture is created, even after the combination and the mixing of the individual fibers 20 and the fiber tufts 71. As a result, the fancy-effect yarn 40 produced has also an irregular pattern, although no controlling device for the fancy effects is provided. The random distribution of the effects results automatically from the separation of fibers and fiber tufts 71.

In the manner described, and by means of the device described, any desired fiber materials can be spun together. The effects appear most distinctly, however, when fiber material of different colors or color tones are fed to the spinning rotor 1 via the two fiber feeding channels 3 and 5. In this manner a yarn with irregular color effects is produced.

As shown in FIG. 1, the fiber feeding channel is of such length that the opening of the fiber sliver 7 into individual fibers and fiber tufts 71 is effected by the fancy-effect fiber material air stream 90, i.e. that it occurs in the fiber channel 5, before the latter lets out into the fiber feeding channel 3 with conveying air stream 9. The forward end 70 of the fiber sliver 7 therefore does not extend into the conveying air stream which conveys the individual fibers 20, separated from the basic fiber material 26, and thus cannot adversely affect the fiber conveying process from opening roller 22 to spinning rotor 1. In order to ensure this, the length of the fiber feeding channel 5 is selected so as to exceed the maximum staple length of the individual fibers 71 contained in the fancy-effect fiber material. In this way the fancy-effect fiber material already opened into individual fibers 71 is introduced by means of this fancy-effect fiber material air stream 90 into the conveying air stream 9 for basic fiber material.

In a variant of the device described and of the process described, it is however also possible to give the fiber feeding channel 5 a shorter length than in the above-mentioned example when there is little space available. The forward end 70 of the fiber sliver 7 should however extend into the fiber feeding channel 3 only for as much as will not interfere with fiber conveying between opening roller 2 and spinning rotor 1. It has been shown that, assuming that the inner diameter of the fiber feeding channel 3 is sufficient, this is generally the case when the fiber feeding channel 5 is at least longer than the minimum staple length of the individual fibers 71 contained in the fancy-effect fiber material.

Through several different additional measures it can be ensured that the fiber orientation of the individual fibers 20 and of the fiber tufts 71 separated from the two fiber materials used is not disturbed. Thus, according to FIG. 3, which shows a variant of the device shown in FIG. 1, the conveying air stream 9 and the fancy-effect fiber material air stream 90 are made to flow essentially in the same direction of flow in the fiber feeding channels 3 and 5, even before coming together. Since the embodiment of the fiber feeding channel 5 shown in FIG. 3 constitutes the rear extension of the fiber feeding channel 3, fiber feeding channel 5 lets out into the fiber feeding channel 3, essentially in the direction of flow of the conveying air stream 9. This is also achieved if the angle $\alpha$ between the two fiber feeding channels 3 and 5 in the embodiment of the device shown in FIG. 1 is kept sufficiently wide.

On the one hand, good mixing of the basic fiber material 26 with the fancy-effect fiber material is desired, so that there are no oversized fiber tufts 71, fed to the spinning element (spinning rotor 1) which otherwise could lead to yarn breakage. On the oher hand however, mixing should also not be excessive, as the mixture would then become too homogenous and the fancy effects would be lost. For this reason the fancy-effect fiber material is fed into the air stream conveying the basic fiber material 26 after the latter's separation from the opening device 2.

Figure 3:
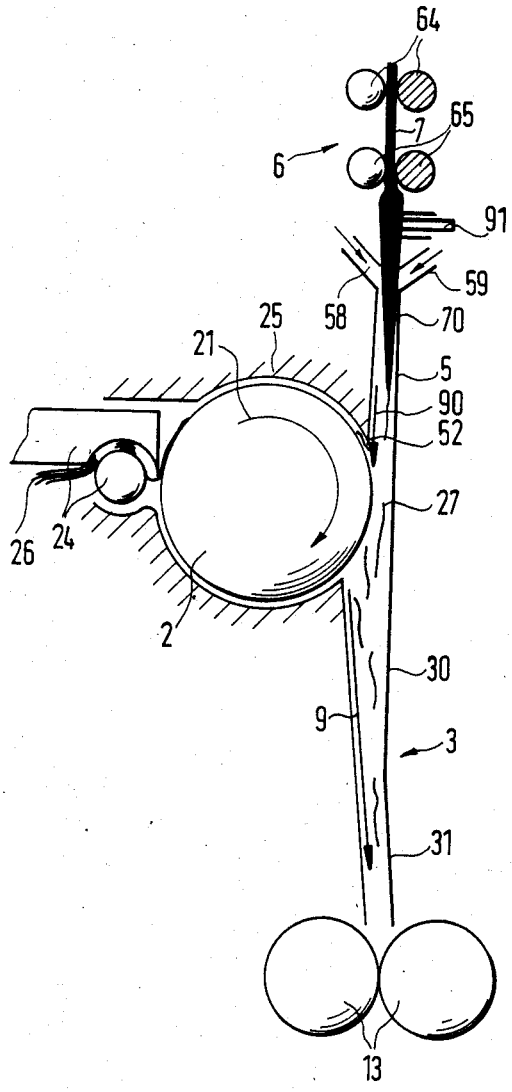
FIG. 3 shows a schematic side view of a variant of the device shown in FIG. 1.

The earlier-mentioned FIG. 3 shows a very early feeding of the fancy-effect fiber material into the discussed conveying air stream for the basic fiber material 26, i.e. tangentially into the housing 25 of the opening roller 22. The inner space in which the opening roller 22 is located has a widening 27 in the area where the fiber feeding channel 3 for basic fiber material 26 begins, so that the individual fibers 20 of the basic fiber material 26 can be separated from the garniture of the opening roller 22 even before they leave the interior of the opening roller housing 25. According to FIG. 3, the fiber feeding channel 5 for the fancy-effect fiber material lets out into this widening 27 of thie interior space so that the fibers and fiber tufts 71 of the fancy-effect fiber material, although still entering the housing of the opening roller 25, do so without coming into contact with the garniture of the opening roller 22.

In order to repair a possible disarrangement of fiber orientation that may have been caused by the joining of the conveying air stream 9 and the fancy-effect fiber material air stream 90, provisions are made according to FIG. 3 for the fiber feeding channel 3 feeding the basic fiber material 26 to incorporate a first conical channel segment 30 and a second, essentially cylindrical channel segment 31. The feeding opening 52 of the fiber feeding channel 5 for the fancy-effect fiber material 7 then lets out in the zone of the first, i.e. the tapering channel segment 30 in the fiber feeding channel 3. In this way the conveying air stream 9 is first accelerated, whereby in addition to the individual fibers 20 of the basic fiber material 26, also the individual fibers 71 of the fancy-effect fiber material, fed into the accelerating conveying air stream by means of the fancy-effect fiber material air stream 90 are straightened. For this to be possible, the determination of the length of fiber feeding channel 5, described above, ensures that the forward end 70 of the fiber sliver 7 be extended only so far into the conical channel segment 30 of the fiber feeding channel 3, so that the separation of the fibers 71 may take place before the end of acceleration of the conveying air stream 9. The combined air stream then reaches the cylindrical channel segment 31 through which it flows at an essentially constant speed. The individual fibers 20 and fiber tufts 71, which can follow the air acceleration only with some delay because of their inertia, are re-accelerated in this stabilization phase, whereby their straightening and parallel orientation is improved.

The device described can be varied by replacing characteristics by equivalents or other combinations. As shown in FIG. 3, the particular configuration of the feeding device 6 does not matter. Thus, instead of the pair of rollers consisting of the feeding roller 60 and the pressure roller 61, it is also possible to provide drawing equipment (see entry roller pair 64 and exit roller pair 65), which reduces the fiber sliver 7 being fed to it to such a thickness that in can be opened into the individual fibers and fiber tufts 71 in the air stream in the second fiber feeding channel 5 (and possibly in the first fiber feeding channel 3, when the forward end 70 of the fiber sliver 7 reach as far as the inside of this first fiber feeding channel). The speed ratios between the entry roller pair 64 and the exit roller pair 65, and possible of additional roller pairs, are here selected so that the fiber sliver being fed in can be reduced to the desired thickness but can definitely not be opened into single fibers and fiber tufts 71.

Just as the particular configuration of the feeding device is in principle unimportant, the open-end spinning element can also be fashioned in different ways. FIG. 3 therefore shows, as an example an embodiment of such a spinning element, a pair of friction rollers 13. In this case the air stream aspired by the spinning elements is weaker than for rotor spinning. For this reason the air stream can in certain cases be reinforced by means of injection nozzles introducing compressed air (see compressed air nozzles 58 and 59).

Although fiber feeding channels 3 and 5 are provided for all of the embodiments described above, it is nevertheless possible, under certain conditions, to do without the fiber feeding channel 5 for the fancy-effect fiber material. The sliver-shaped special-effect fiber material is introduced into the fiber feeding channel 3 via a feeding opening 52, whereby it is ensured, by means of an appropriately sized gap between the feeding device 6 and the feeding opening 52 and thereby fiber feeding channel 3, that the fiber sliver 7 only extends so far into the feeding channel 3 as to ensure proper opening of the fancy-effect fiber material therein.

Figure 2:
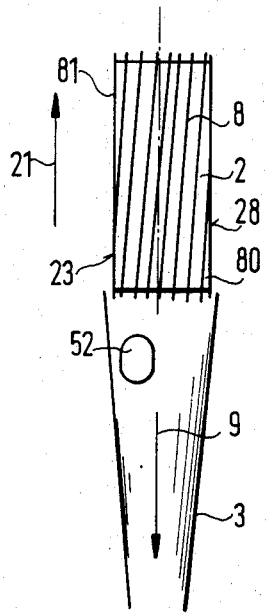
FIG. 2 shows a schematic cross-section of the arrangement of the outlet of a second fiber feeding channel into the first fiber feeding channel in connection with an opening roller equipped with an opening winding.

As FIG. 2 shows, the opening roller 22 is equipped with a saw-tooth-like garniture winding 8. Air travels through the screw-like turns of the garniture winding 8 from the one face 28 of the opening roller 22, on which the forward end 80 of the garniture winding 8 is located as the opening roller 22 rotates (arrow 21) in direction of face 23, at which the rear end 81 of the garniture winding 8 is located, or vice versa. The direction into which the air drifts off to the side depends on whether the peripheral speed of the opening roller 22 is greater than the air speed, or vice versa. The air speed thus increases over the cross section in direction of face 23 or 28 of the opening roller 22. So that this increased air speed and the injector effect it provokes may be fully be utilized for the opening of the fancy-effect fiber material, the fancy-effect fiber material is fed into the conveying air stream 9 for the basic fiber material 26 at the point of the profile where air speed is highest. According to FIG. 2 this should be at the face 23 of the opening roller 22, and for this reason fiber feeding channel 5 lets out into the fiber feeding channel 3 in the direction of face 23 of the opening roller 2 at an offset in this embodiment. Thus the feeding opening 52 lets out in the area of higher air flow speed within fiber feeding channel 3, i.e. on that side of the fiber feeding channel 3 to which the air is being conveyed through the garniture windings 8.

Figure 5:
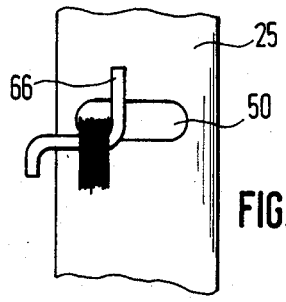
FIG. 5 shows a top view of the feeding opening of the second fiber feeding channel.

When the fiber feeding channel 5 is of the same width as the fiber feeding channel 3, a sliver guide 66 (FIG. 5) is installed before the introduction of the fiber sliver 7 into the second fiber feeding channel 3 so that it holds the fiber sliver 7 on that side of the fiber feeding channel 5 on which the higher air speed is produced in the fiber feeding channel 3.

By means of the described asymmetric feeding of the fancy-effect fiber material 7 into a profile zone of the fiber feeding channel 3 in which higher air flow speed prevails, an intensive suction effect is exerted upon fiber sliver 7 becauce the air stream velocity is considerable greater than the feeding rate of the fiber sliver 7, so that the normal negative spinning pressure at the spinning element also suffices for the opening of the fiber sliver 7.

To obtain a variety of fancy-effect yarns it is also possible to connect the feeding device 6 to motor 63 (FIG. 1) so that the transmission ratio can be set for different values. This can be achieved through the replacement of gears on the drive shafts of motor 63 and of feeding roller 60 for example. Depending on the desired intensity of the effects, a higher or lower feeding speed can thus be selected for the feeding device. However this speed then remains constant during the production process.

Figure 4:
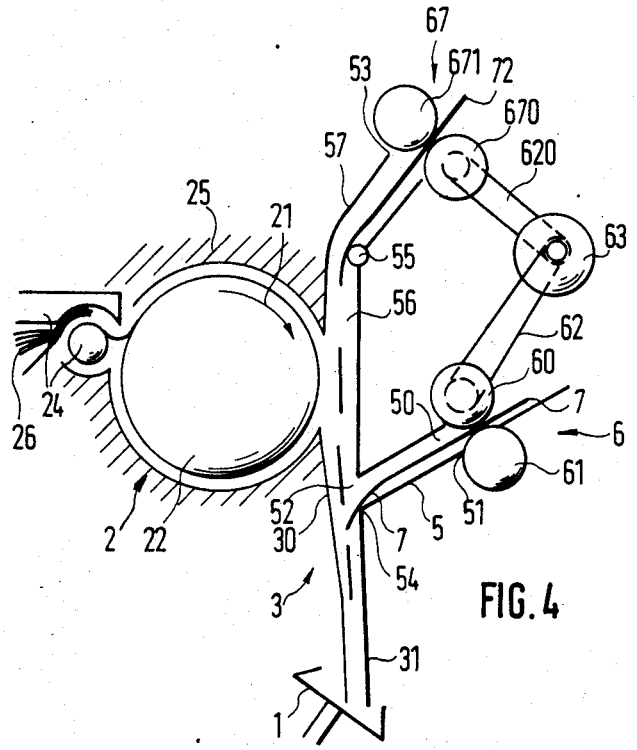
FIG. 4 shows a schematic side view of an embodiment of the inventive device with two feeding devices for the fancy-effect fiber material.

Provisions can also be made to feed fancy-effect fiber material in the form of an additional fiber sliver 72 (FIG. 4) through an additional fiber feeding channel 57, besides fiber feeding channel 5, with an air intake opening 53, a feeding opening 56 and a feeding device 67 letting out into the fiber feeding channel 3. The feeding device 67 also consists of a feeding roller 670 and a pressure roller 671. The feeding roller 670 is driven by motor 63 via overdrive belt 620. For the effects produced by the fiber sliver 7, fed by the feeding device 6 and those produced by the fiber sliver 72, fed by the feeding device 67 to be of different intensity, feeding devices 6 and 67 are driven at different constant speeds by motor 63 through appropriate selection of the gearing ratios.

The fancy-effect fiber material of different fiber slivers 7 and 72 can be fed into fiber feeding channel 3 through several or through one single feeding opening, depending on available space. In the latter case, the combination of the fancy-effect fiber material which has been opened or is yet to be opened occurs at the latest at the common feeding opening.

In order to establish defined opening conditions the fiber sliver 7 and/or 72 can be retained by the feeding device 6 or 67 as it is exposed to the flow of air. However it is also possible to provide a retaining or tearing-off edge 54 between feeding device 6 or 67 and the first fiber feeding channel 3. According to FIG. 1 it is located between fiber feeding channel 5 and fiber feeding channel 3. Also according to FIG. 4, a tear-off edge 54 is provided at this point, while a tear-off edge 55, made in form of a pin is installed at a bend in the fiber feeding channel 57. Such a tear-off edge 54 or 55 is very important, since it limits the effect of the air upon the free end of the fiber sliver 7 or 72. Thereby the arrival of oversized bunches of fibers into the spinning element, causing possible yarn breakage, is avoided.

If normal yarn, without any fancy effects is to be produced by means of the above-described open-end spinning device, it suffices to interrupt the feeding of fancy-effect fiber material through the feeding opening 52 and/or 57. This is done by switching off the drive of the feeding device 6 and/or 67. The air intake opening 51 or 53, which is required in fancy-yarn spinning to produce a current of conveying or opening air, has no effect upon the conveying of the individual fibers 20 separated from the basic fiber material. If however air intake is not be desired for reasons of air management in the open-end spinning device, it is also possible, as indicated schematically in FIG. 3, to equip the fiber feeding channel 5 with a controllable closing element 91 which prevents such air intake in its closed position. The design of the closing device and its control can vary according to requirements. In order to avoid affecting the conveying of the individual fibers 71 separated from the fiber sliver 7 in their travel to fiber feeding channel 3, and to exclude the risk of fiber accumulation, the closing element 91 in the embodiment shown in FIG. 3 is located in that zone of the fiber feeding channel 3 in which the fiber sliver 7 has not yet been opened into individual fibers and fiber tufts.

What is claimed:

1. A process for producing a fancy yarn on an open-end spinning machine having a conventional sliver-form input of basic fiber material fed to an opening device of such machine for opening such basic material into individual fibers, with subsequent feeding of such opened fiber in an air stream to a spinning element of such machine for spinning thereof into yarn, said process including:

providing a feeding device for feeding a sliver-form input of fancy-effect fiber material at a constant speed; and directing the leading edge of such fancy-effect sliver, under control of such feeding device therefor, into communication with the air stream within the spinning machine, whereby individual fibers and fiber tufts of the fancy-effect material are separated from the sliver thereof, and fed together with the opened basic fiber material to the spinning element for being spun into fancy yarn.

2. A process as in claim 1, wherein:

the air stream of the spinning machine is present in a first channel thereof; and said directing step includes providing a second channel with the fancy-effect sliver fed thereto, such second channel being brought into communication with such first channel so that the air stream is also established in such second channel, whereby a force is established for the separation of the fancy-effect sliver.

3. A process as in claim 2, wherein the point at which individual fibers and/or tufts separate from the fancy-effect sliver is adjusted to be generally within either the first or second channel.

4. A process as in claim 1, wherein the speed of the air stream is considerably higher than the constant speed at which the fancy-effect fiber material is fed.

5. A process as in claim 1, wherein the fancy-effect fiber material sliver is subjected to retention by the feeding device thereof, with such retention force being overcome at irregular intervals by the suction force of the air stream so that fibers and tufts of fibers are randomly separated from the fancy-effect sliver.

6. A process as in claim 2, wherein the fancy-effect fiber material is separated in the second channel into fiber tufts or individual fibers, with such separated fiber tufts and/or individual fibers then being directed by the air stream into the first channel for combining with the opened basic fiber material.

7. A process as in claim 1, wherein the fancy-effect fiber material is brought into the air stream in an area of acceleration of such air stream.

8. A process as in claim 7, wherein separation of the fancy-effect fiber material sliver occurs before the end of such acceleration area of the air stream.

9. A process as in claim 2, wherein the respective air streams in both of said channels are flowing in essentially the same direction in the area where such channels are communicated together.

10. A process as in claim 2, wherein the second channel is communicated with the first channel in an area thereof where the speed of the air stream therein is greatest, whereby separated fibers and fiber tufts present in such first channel may tend to be straightened.

11. A process as in claim 1, wherein the constant feeding speed of the fancy-effect fiber material sliver is determined generally in accordance with the desired effects to be obtained for the fancy yarn to be produced.

12. A process as in claim 1, further including providing and directing more than one fancy-effect sliver for separation by the air stream to be fed together with the opened material to be spun into yarn.

13. A process as in claim 12, wherein each of the fancy-effect slivers are fed at different constant speeds.

14. A process as in claim 12, wherein the plurality of fancy-effect slivers each have distinct physical characteristics distinguishing themselves from one another.

15. An open-end spinning apparatus for producing a fancy yarn, comprising:

an opening device adapted for receiving basic fiber material and opening same into individual fibers;

a spinning device for spinning fibers and fiber tufts into yarn, while creating a suction air stream directed theretowards;

a first fiber feeding channel connecting said opening device with said spinning device, with said suction air stream operative therein to direct opened basic fibers along said first channel towards said spinning device;

a feeding opening defined in said first fiber feeding channel; and a feeding device for feeding fancy-effect fiber material at a constant speed to said feeding opening so as to enter said first fiber feeding channel, whereby fancy-effect fibers are directed by said suction air stream therein along with said opened basic fibers towards said spinning device to be collectively spun into fancy yarn.

16. An apparatus as in claim 15 further including a retaining edge provided between said feeding device and said first fiber feeding channel.

17. An apparatus as in claim 15, wherein:

said first fiber feeding channel includes surfaces of predetermined profile therein for varying the flow speed of said suction air stream therein; and said feeding opening is positioned in said fiber feeding channel so as to be located in an area of higher air speed thereof.

18. An apparatus as in claim 17, further comprising a sliver guide for holding a sliver of said fancy-effect fiber material in such area of higher air speed.

19. An apparatus as in claim 15, wherein said first fiber feeding channel includes a tapering segment followed downstream relative the air flow direction of said suction air stream by a cylindrical segment; and said feeding opening is located in said tapering segment of said first fiber feeding channel.

20. An apparatus as in claim 15, further including a second fiber feeding channel for inter-connecting said feeding device and said feeding opening, the length of said second channel exceeding the maximum staple length of individual fibers of said fancy-effect fiber material.

21. An apparatus as in claim 20, wherein said second fiber feeding channel connects with said first fiber feeding channel essentially in a longitudinal sense thereof.

22. An apparatus as in claim 21, wherein said opening device includes a rotatable opening roller, with said first fiber feeding channel being tangent to said opening roller, and said second fiber feeding channel substantially forming a rear extension of said first fiber feeding channel.

23. An apparatus as in claim 22, further comprising a housing for said opening roller, said housing in an area where said first fiber feeding channel is tangent thereto having a widened area into which said second fiber feeding channel enters also at a tangent.

24. An apparatus as in claim 15, further comprising a controllable closing element associated with said feeding opening for selectively closing same.

25. An apparatus as in claim 20, further comprising a controllable closing element disposed in said second fiber feeding channel for selectively closing same, the positioning of such closing element in such second channel being upstream of an area where said fancy-effect fiber material is yet unopened by said suction air stream operative therein due to said connecting of said first and second channels.

26. An apparatus as in claim 15, wherein said feeding device includes an adjustable drive for selectively establishing said constant speed.

27. An apparatus as in claim 15, wherein said feeding device includes a pair of rollers.

28. An apparatus as in claim 15, wherein said feeding device includes drawing rollers.

29. An apparatus as in claim 15, further including at least another feeding device and respective feeding opening therefor for feeding other fancy-effect fiber material into said first fiber feeding channel so as to be directed towards said spinning device to be collectively spun into fancy yarn with the other fibers directed to said spinning device.

30. An open-end spinning apparatus adapted for producing yarn having randomly distributed fancy effects therein, comprising:

opening means for opening a sliver of basic fiber material fed thereto into opened individual basic fibers;

spinning means for spinning opened fibers and fiber tufts fed thereto into yarn;

means for conveying opened basic fibers from said opening means to said spinning means; and pneumatic means for pneumatically separating and opening fancy-effect fibers and fiber tufts from a sliver of fancy-effect fiber material, and for directing a stream of randomly varying sequence and size of such fancy-effect fibers and tufts to said spinning means, whereby all opened fibers directed to said spinning means are collectively spun thereby into a fancy yarn having a random distribution of fancy-effect material therein.

31. An apparatus as in claim 30, wherein said pneumatic means includes:

feeding means for controllably feeding said fancy-effect material sliver at a predetermined constant feeding speed; and channel means for directing said sliver towards said spinning means with spinning suction force therefrom directed therealong to establish a suction air stream having an air speed higher than said predetermined constant feeding speed, whereby frictional forces of said fancy-effect material sliver and said controlled feeding thereof are randomly overcome in an irregular manner by said suction air stream so that said random stream of opened fancy-effect fibers is pneumatically produced without requiring any mechanical opening devices having special controls for producing random operation thereof.

32. A method of adapting a conventional open-end spinning machine for producing fancy yarn having randomly distributed fancy effects therein, said machine including an opening device opening basic fiber material input thereto, with such opened basic fibers being fed with spinning suction in a fiber feeding channel to a spinning device to be spun thereby into thread, said method including the steps of:

controllably feeding a sliver of fancy-effect fiber material to the vicinity of the machine fiber feeding channel; and selectively exposing such controllably fed sliver to the spinning suction within such channel, whereby individual fibers and tufts of varying size of such fancy-effect material may be separated and drawn off in an irregular manner from such sliver, mixed with the opened basic fibers, and fed to the machine spinning device to be spun into fancy yarn having randomly distributed fancy effects therein resulting automatically from such irregular separation of the fancy-effect sliver, without requiring a randomly-controlled, mechanical opening device for the fancy-effect fibers.

* * * * *